US009249676B2

(12) United States Patent
Antonellis et al.

(10) Patent No.: US 9,249,676 B2
(45) Date of Patent: Feb. 2, 2016

(54) TURBINE ROTOR COVER PLATE LOCK

(75) Inventors: Stephen M. Antonellis, South Glastonbury, CT (US); Frank Heydrich, Phoenix, AZ (US)

(73) Assignee: United Technologies Corporation, Hartford, CT (US)

( * ) Notice: Subject to any disclaimer, the term of this patent is extended or adjusted under 35 U.S.C. 154(b) by 912 days.

(21) Appl. No.: 13/488,844

(22) Filed: Jun. 5, 2012

(65) Prior Publication Data

US 2013/0323067 A1 Dec. 5, 2013

(51) Int. Cl.

| | |
|---|---|
| ***F01D 5/32*** | (2006.01) |
| ***F01D 5/30*** | (2006.01) |
| ***F01D 11/00*** | (2006.01) |

(52) U.S. Cl.

CPC ..... *F01D 5/326* (2013.01); *F01D 5/3015* (2013.01); *F01D 11/006* (2013.01); *F05D 2230/64* (2013.01); *F05D 2250/182* (2013.01)

(58) Field of Classification Search

CPC ..... F01D 5/3015; F01D 5/32; F01D 5/323; F01D 5/326

USPC ..... 403/318, 319, 355, 356

See application file for complete search history.

(56) References Cited

U.S. PATENT DOCUMENTS

| | | | | |
|---|---|---|---|---|
| 4,021,138 | A | 5/1977 | Scalzo | |
| 4,505,640 | A | 3/1985 | Hsing et al. | |
| 4,659,285 | A | 4/1987 | Kalogeros et al. | |
| 4,846,628 | A | 7/1989 | Antonellis | |
| 5,582,077 | A * | 12/1996 | Agram | F01D 5/027 403/318 |
| 5,993,160 | A | 11/1999 | Bouchard et al. | |
| 7,371,044 | B2 | 5/2008 | Nereim | |
| 7,877,891 | B2 | 2/2011 | Petroskie et al. | |
| 7,958,734 | B2 | 6/2011 | Paprotna et al. | |
| 2006/0130456 | A1 | 6/2006 | Suciu et al. | |
| 2006/0153683 | A1 | 7/2006 | Dube et al. | |
| 2009/0148295 | A1 | 6/2009 | Caprario et al. | |
| 2010/0043507 | A1 * | 2/2010 | Dreisbach et al. | 70/164 |
| 2010/0196164 | A1 | 8/2010 | Liotta et al. | |
| 2011/0206519 | A1 | 8/2011 | Heinemann et al. | |
| 2012/0027598 | A1 | 2/2012 | Caprario | |
| 2012/0315142 | A1 | 12/2012 | Bosco | |

FOREIGN PATENT DOCUMENTS

| | | |
|---|---|---|
| EP | 1650406 A2 | 4/2006 |

OTHER PUBLICATIONS

International Preliminary Report on Patentability for PCT Application No. PCT/US2013/042816, mailed Dec. 18, 2014.

International Search Report and Written Opinion for PCT Application No. PCT/US2013/042816 mailed on Jul. 25, 2013.

European Search Report for EP Application No. 13800679.6 dated May 26, 2015.

* cited by examiner

*Primary Examiner* — Richard Edgar

*Assistant Examiner* — Brian O Peters

(74) *Attorney, Agent, or Firm* — Carlson, Gaskey & Olds, P.C.

(57) ABSTRACT

A rotor assembly for a gas turbine engine includes a rotor configured for rotation about an engine axis, the rotor including an aft surface including a rotor slot and a cover plate attached to the aft surface of the rotor, the cover plate including a tab received within the rotor slot and a cover plate slot aligned with the rotor slot. A lock assembly disposed within the rotor slot holds a position of the cover plate relative to the rotor. The lock assembly includes a key portion conforming to the rotor slot, a lock portion engageable with a surface of the rotor slot and a threaded member for holding the lock assembly within the rotor slot.

18 Claims, 7 Drawing Sheets

TURBINE ROTOR COVER PLATE LOCK

BACKGROUND

A gas turbine engine typically includes a fan section, a compressor section, a combustor section and a turbine section. Air entering the compressor section is compressed and delivered into the combustion section where it is mixed with fuel and ignited to generate a high-speed exhaust gas flow. The high-speed exhaust gas flow expands through the turbine section to drive the compressor and the fan section. The compressor section typically includes low and high pressure compressors, and the turbine section includes low and high pressure turbines.

In some engine turbine section configurations, a cover is secured to a side of a rotor. The cover is assembled through slots then rotated or clocked to secure the cover in place. The cover is typically heated during assembly, and then cooled once installed to provide an interference fit. In some configurations, an anti-rotation feature is utilized to prevent rotation of the cover. The anti-rotation features experience temperature variations along with circumferential forces during operation. Accordingly, it is desirable to design and develop anti-rotation features that are cost effective and provide a desired performance in the operational environment of a turbine rotor.

SUMMARY

A rotor assembly for a gas turbine engine according to an exemplary embodiment of this disclosure, among other possible things includes a rotor configured for rotation about an engine axis, the rotor including an aft surface including a rotor slot, a cover plate attached to the aft surface of the rotor, the cover plate including a tab received within the rotor slot and a cover plate slot aligned with the rotor slot. A lock assembly is disposed within the rotor slot for holding a position of the cover plate relative to the rotor. The lock assembly includes a key portion conforming to the rotor slot, a lock portion engageable with a surface of the rotor slot and a threaded member.

In a further embodiment of the foregoing rotor assembly, the rotor includes an aft wall defining the rotor slot and an annular channel forward of the aft wall, wherein the tab is received through the rotor slot and rotated circumferentially within the annular channel to align the rotor slot and the cover slot.

In a further embodiment of any of the foregoing rotor assemblies, the lock portion includes a barrel disposed about a central axis and a flange extending from the barrel, the barrel including threads configured to receive the threaded member.

In a further embodiment of any of the foregoing rotor assemblies, the flange extends parallel to the central axis.

In a further embodiment of any of the foregoing rotor assemblies, the flange engages an inner surface of the annular channel of the rotor to hold the locking assembly within the rotor slot.

In a further embodiment of any of the foregoing rotor assemblies, the key includes a lip contacting the aft surface of the cover plate.

In a further embodiment of any of the foregoing rotor assemblies, the flange of the lock is engageable to a portion of the key to prevent relative rotation therebetween.

In a further embodiment of any of the foregoing rotor assemblies, the key includes a window for viewing a position of the lock when assembled to the rotor slot.

A lock assembly for preventing movement between assembled structures according to an exemplary embodiment of this disclosure, among other possible things includes a key including a lip configured to engage an outside surface of one of the assembled structures. A lock includes a flange configured to engage an inner surface of the other of the assembled structures, and a fastening member configured to hold the lock and key in a fastened position.

In a further embodiment of the foregoing lock assembly, the lock comprises a barrel with an internal bore including threads corresponding to threads on the fastening member and a flange extending transverse to the bore.

In a further embodiment of any of the foregoing lock assemblies, includes a window.

In a further embodiment of any of the foregoing lock assemblies, the lip of the key defines a first contact surface and the flange defines a second contact surface spaced a distance from each other in a direction transverse to an axis of rotation of the fastening member.

In a further embodiment of any of the foregoing lock assemblies, the lock engages a portion of the key for controlling a position of the lock relative to the key.

A method of assembling a cover plate to a turbine rotor according to an exemplary embodiment of this disclosure, among other possible things includes inserting a tab of a cover plate through a rotor slot, rotating the cover plate to align a cover plate slot with the rotor slot, setting a locking assembly into an assembly orientation, inserting the locking assembly into the rotor slot to contact a key with an outer surface of one of cover plate, moving a lock of the locking assembly to a lock position, and tightening a fastener to engage the lock of the locking assembly within the rotor slot.

In a further embodiment of the foregoing method, includes tightening the fastener to engage the lock with an inner surface of the rotor and a lip of the key with the cover plate.

In a further embodiment of any of the foregoing methods, includes holding the assembly orientation of the lock relative to the key by contacting a portion of the lock with the key.

In a further embodiment of any of the foregoing methods, includes viewing a position of the lock through a window of the key for visually confirming a desired locking orientation of the lock.

Although the different examples have the specific components shown in the illustrations, embodiments of this invention are not limited to those particular combinations. It is possible to use some of the components or features from one of the examples in combination with features or components from another one of the examples.

These and other features disclosed herein can be best understood from the following specification and drawings, the following of which is a brief description.

DETAILED DESCRIPTION

Figure 1:
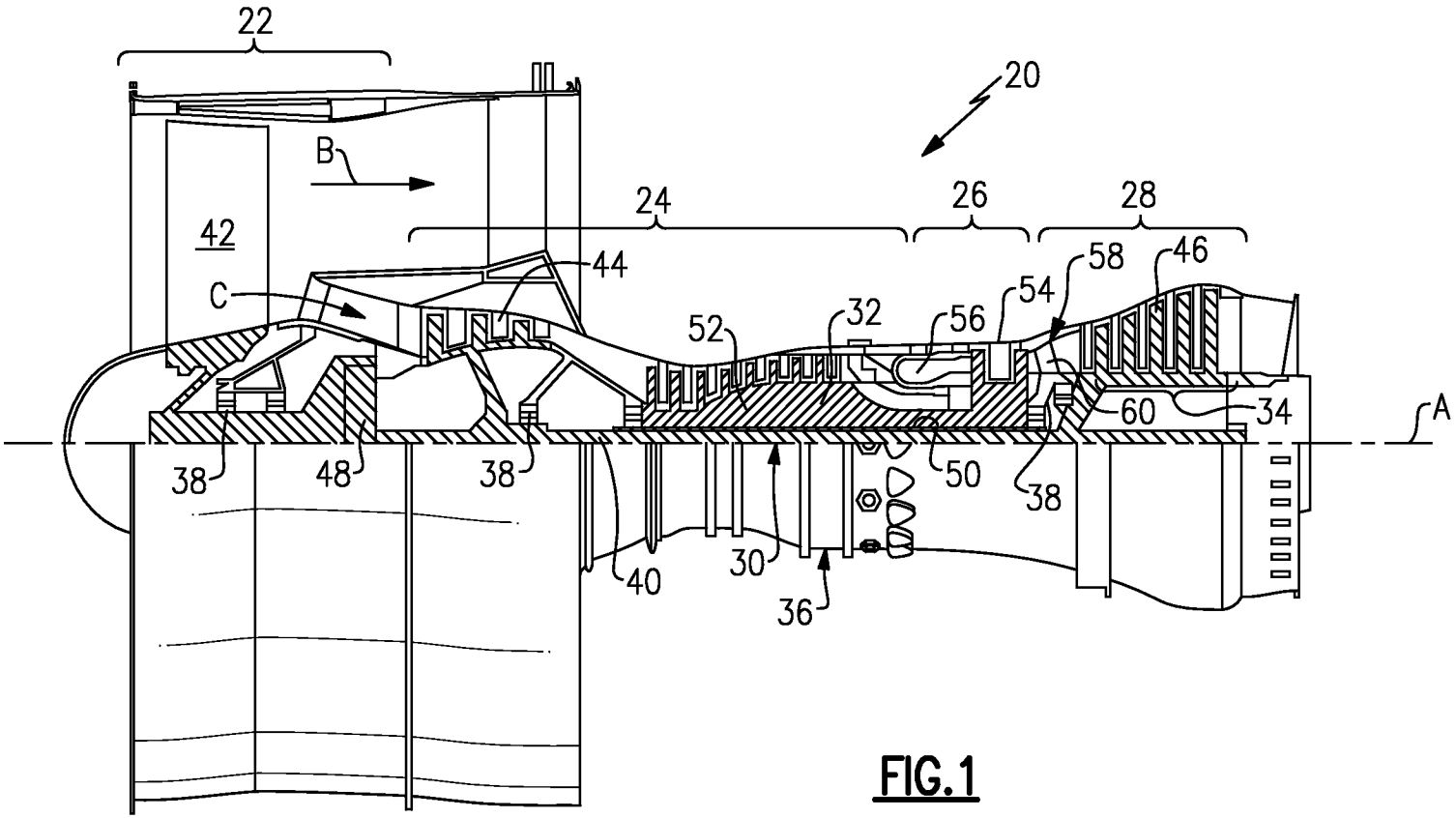
FIG. 1 is a schematic view of an example gas turbine engine.

FIG. 1 schematically illustrates an example gas turbine engine 20 that includes a fan section 22, a compressor section 24, a combustor section 26 and a turbine section 28. Alternative engines might include an augmenter section (not shown) among other systems or features. The fan section 22 drives air along a bypass flow path B while the compressor section 24 draws air in along a core flow path C where air is compressed and communicated to a combustor section 26. In the combustor section 26, air is mixed with fuel and ignited to generate a high pressure exhaust gas stream that expands through the turbine section 28 where energy is extracted and utilized to drive the fan section 22 and the compressor section 24.

Although the disclosed non-limiting embodiment depicts a turbofan gas turbine engine, it should be understood that the concepts described herein are not limited to use with turbofans as the teachings may be applied to other types of turbine engines; for example a turbine engine including a three-spool architecture in which three spools concentrically rotate about a common axis and where a low spool enables a low pressure turbine to drive a fan via a gearbox, an intermediate spool that enables an intermediate pressure turbine to drive a first compressor of the compressor section, and a high spool that enables a high pressure turbine to drive a high pressure compressor of the compressor section.

The example engine 20 generally includes a low speed spool 30 and a high speed spool 32 mounted for rotation about an engine central longitudinal axis A relative to an engine static structure 36 via several bearing systems 38. It should be understood that various bearing systems 38 at various locations may alternatively or additionally be provided.

The low speed spool 30 generally includes an inner shaft 40 that connects a fan 42 and a low pressure (or first) compressor section 44 to a low pressure (or first) turbine section 46. The inner shaft 40 drives the fan 42 through a speed change device, such as a geared architecture 48, to drive the fan 42 at a lower speed than the low speed spool 30. The high-speed spool 32 includes an outer shaft 50 that interconnects a high pressure (or second) compressor section 52 and a high pressure (or second) turbine section 54. The inner shaft 40 and the outer shaft 50 are concentric and rotate via the bearing systems 38 about the engine central longitudinal axis A.

A combustor 56 is arranged between the high pressure compressor 52 and the high pressure turbine 54. In one example, the high pressure turbine 54 includes at least two stages to provide a double stage high pressure turbine 54. In another example, the high pressure turbine 54 includes only a single stage. As used herein, a "high pressure" compressor or turbine experiences a higher pressure than a corresponding "low pressure" compressor or turbine.

The example low pressure turbine 46 has a pressure ratio that is greater than about 5. The pressure ratio of the example low pressure turbine 46 is measured prior to an inlet of the low pressure turbine 46 as related to the pressure measured at the outlet of the low pressure turbine 46 prior to an exhaust nozzle.

A mid-turbine frame 58 of the engine static structure 36 is arranged generally between the high pressure turbine 54 and the low pressure turbine 46. The mid-turbine frame 58 further supports bearing systems 38 in the turbine section 28 as well as setting airflow entering the low pressure turbine 46.

The core airflow C is compressed by the low pressure compressor 44 then by the high pressure compressor 52 mixed with fuel and ignited in the combustor 56 to produce high speed exhaust gases that are then expanded through the high pressure turbine 54 and low pressure turbine 46. The mid-turbine frame 58 includes vanes 60, which are in the core airflow path and function as an inlet guide vane for the low pressure turbine 46. Utilizing the vane 60 of the mid-turbine frame 58 as the inlet guide vane for low pressure turbine 46 decreases the length of the low pressure turbine 46 without increasing the axial length of the mid-turbine frame 58. Reducing or eliminating the number of vanes in the low pressure turbine 46 shortens the axial length of the turbine section 28. Thus, the compactness of the gas turbine engine 20 is increased and a higher power density may be achieved.

The disclosed gas turbine engine 20 in one example is a high-bypass geared aircraft engine. In a further example, the gas turbine engine 20 includes a bypass ratio greater than about six (6), with an example embodiment being greater than about ten (10). The example geared architecture 48 is an epicyclical gear train, such as a planetary gear system, star gear system or other known gear system, with a gear reduction ratio of greater than about 2.3.

In one disclosed embodiment, the gas turbine engine 20 includes a bypass ratio greater than about ten (10:1) and the fan diameter is significantly larger than an outer diameter of the low pressure compressor 44. It should be understood, however, that the above parameters are only exemplary of one embodiment of a gas turbine engine including a geared architecture and that the present disclosure is applicable to other gas turbine engines.

A significant amount of thrust is provided by the bypass flow B due to the high bypass ratio. The fan section 22 of the engine 20 is designed for a particular flight condition—typically cruise at about 0.8 Mach and about 35,000 feet. The flight condition of 0.8 Mach and 35,000 ft., with the engine at its best fuel consumption—also known as "bucket cruise Thrust Specific Fuel Consumption ("TSFC")"—is the industry standard parameter of pound-mass (lbm) of fuel per hour being burned divided by pound-force (lbf) of thrust the engine produces at that minimum point.

"Low fan pressure ratio" is the pressure ratio across the fan blade alone, without a Fan Exit Guide Vane ("FEGV") system. The low fan pressure ratio as disclosed herein according to one non-limiting embodiment is less than about 1.50. In another non-limiting embodiment the low fan pressure ratio is less than about 1.45.

"Low corrected fan tip speed" is the actual fan tip speed in ft/sec divided by an industry standard temperature correction of $[(\text{Tram } °R)/518.7)^{0.5}]$. The "Low corrected fan tip speed", as disclosed herein according to one non-limiting embodiment, is less than about 1150 ft/second.

The example gas turbine engine includes the fan 42 that comprises in one non-limiting embodiment less than about 26 fan blades. In another non-limiting embodiment, the fan section 22 includes less than about 20 fan blades. Moreover, in one disclosed embodiment the low pressure turbine 46 includes no more than about 6 turbine rotors schematically indicated at 34. In another non-limiting example embodiment the low pressure turbine 46 includes about 3 turbine rotors. A ratio between the number of fan blades 42 and the number of low pressure turbine rotors is between about 3.3 and about 8.6. The example low pressure turbine 46 provides the driving power to rotate the fan section 22 and therefore the relationship between the number of turbine rotors 34 in the low pressure turbine 46 and the number of blades 42 in the fan section 22 disclose an example gas turbine engine 20 with increased power transfer efficiency.

Figure 2:
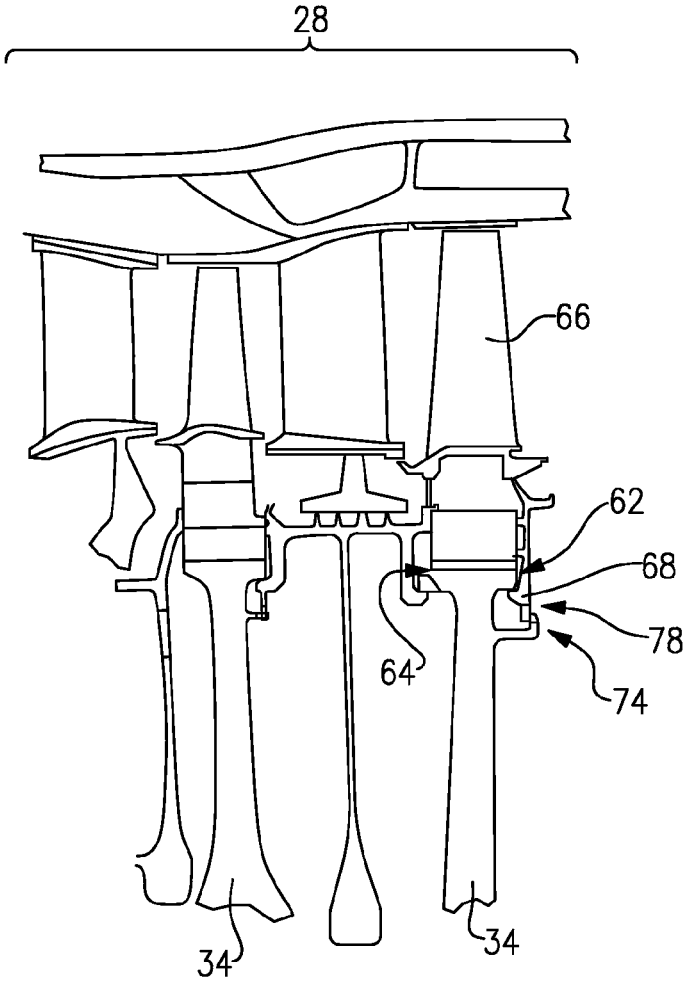
FIG. 2 is a cross section of a portion of an example turbine section.
Figure 3:
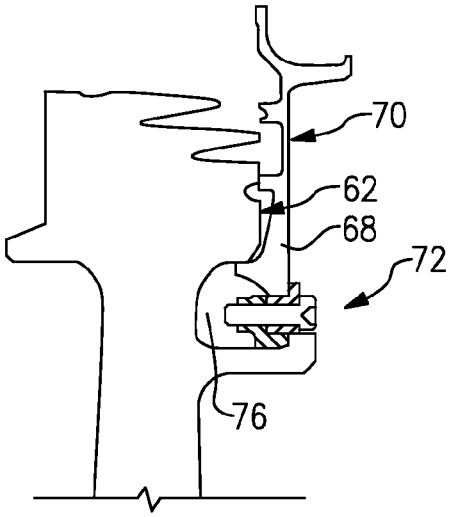
FIG. 3 is a schematic of an example rotor and cover plate assembly.
Figure 4A:
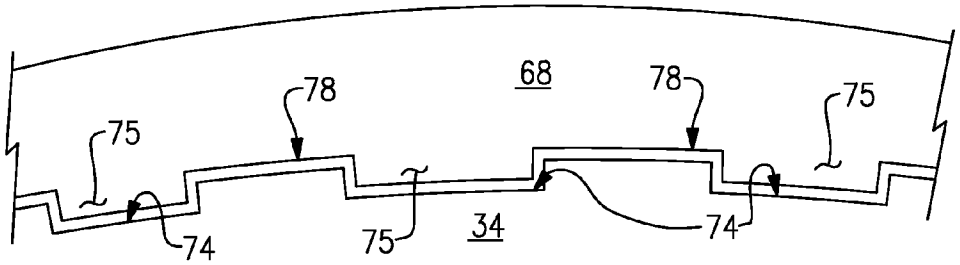
FIG. 4A is a schematic view of an initial alignment between an example cover plate and rotor.
Figure 4B:
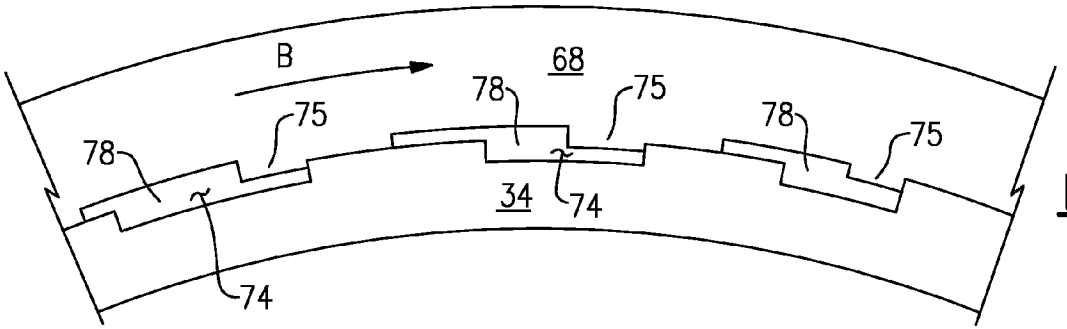
FIG. 4B is a schematic view of the example cover plate rotated partially to an assembled position.

Referring to FIGS. 2 and 3, the example turbine section 28 includes the rotors 34. The aft most rotor 34 includes an aft surface 62 and a forward surface 64. A cover plate 68 is assembled to the aft surface 62 of the rotor 34. The cover plate 68 aids in holding a turbine blade 66 within the rotor 34. The rotor 34 includes a rotor slot 74 and the cover plate 68 includes a cover plate slot 78. Between the various cover plate slots 78 is a cover plate tab 75 (FIG. 4A-B). A lock assembly 72 prevents movement of the cover plate 68 relative to the rotor 34.

Figure 4C:
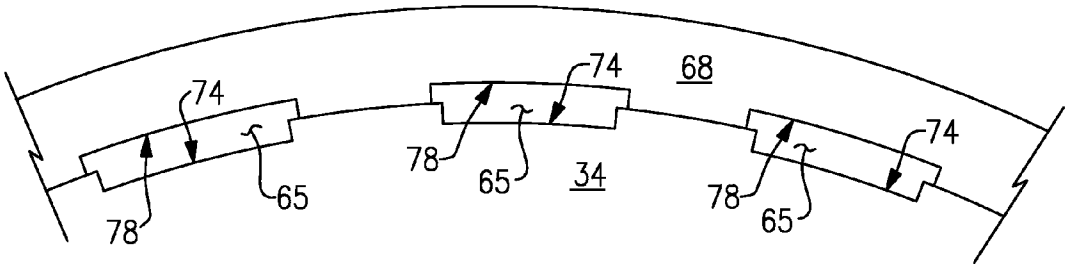
FIG. 4C is a schematic view of the example cover plate in the assembled position.

Referring to FIGS. 4A-C, the example cover plate 68 is installed onto the rotor 34 by aligning tabs 75 with slots 74 and the rotor 34. Cover blade 68 is then inserted through the rotor slots 74 such that the tabs 75 are disposed behind the slots 74 of the rotor 34. The tabs 75 extend into the annular channel 76 (FIG. 3) that is disposed behind the slot 74.

Referring to FIG. 4B, the cover plate 68 is then rotated in a direction of the arrow B to move the cover plate 68 towards a position where slots 78 of the cover plate 68 are aligned with slots 74 of the rotor 34.

Referring to FIG. 4C, the cover plate 68 is shown where the cover plate slots 78 are aligned with rotor slots 74 to define an opening 65. The opening 65 is defined partially by the rotor slot 74 and also partially by the cover plates slot 78.

During assembly of the cover plate 68 to the rotor 34, the rotor 34 is heated to expand it relative to the cover plate 68. Once the cover plate 68 is inserted through the rotor slots 74 such that the rotor slot 74 and cover plate 68 are aligned to define the opening 65 the cover plate 68 is cooled. Upon cooling, an interference fit between the cover plate 68 and the rotor 34 is formed. The example lock assembly 72 is inserted within the openings 65 to prevent the cover plate 68 from rotating toward a direction away from the assembled position.

Figure 5A:
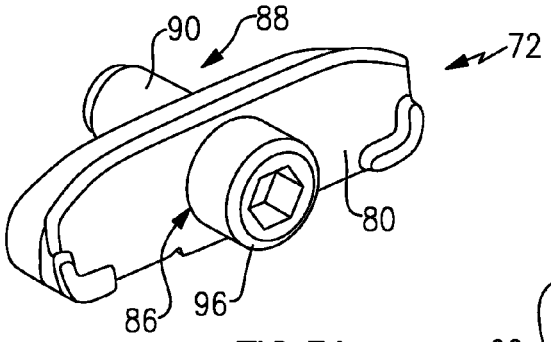
FIG. 5A is a front perspective view of an example locking assembly.
Figure 5B:
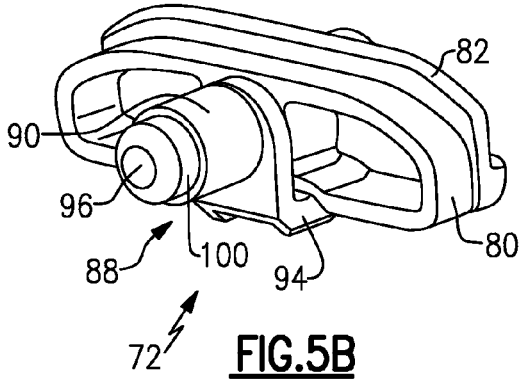
FIG. 5B is a rear perspective view of an example locking assembly.
Figure 5C:
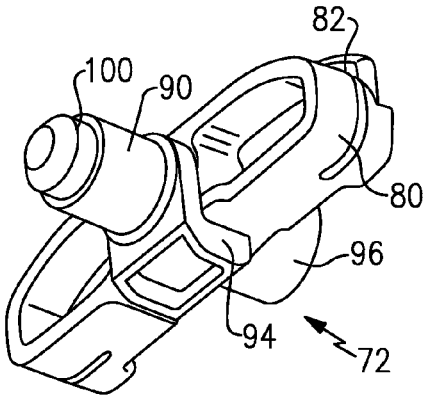
FIG. 5C is a bottom perspective view of the example locking assembly.

Referring to FIGS. 5A, 5B, 5C, the example lock assembly 72 includes a key 80 that has an opening 86 through which a fastening member 96 extends. In this example, the fastening member 96 is a threaded bolt. The threaded bolt 96 extends through the opening 86 defined in the key 80. A threaded end 100 of the bolt 96 engages a lock 88. The lock 88 includes a barrel 90 that has corresponding threads 92 to receive the threaded member 96. The lock 88 also includes a flange portion 94 that extends from the barrel 90. The flange 94 is configured to engage an inner portion of the rotor slot 74 and the key 80 includes a lip 82 that is configured to engage an outer surface 70 of the cover plate 68.

Figure 6:
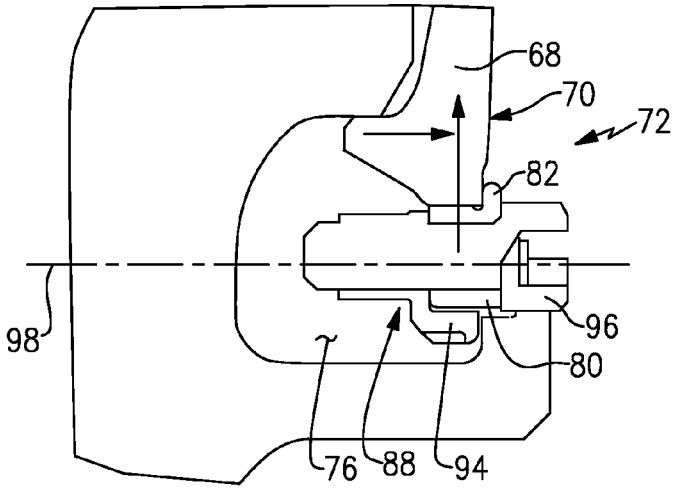
FIG. 6 is a cross sectional view of an example locking assembly installed within a rotor slot.

Referring to FIG. 6, the example lock assembly 72 is shown installed within the opening 65 and includes the lip portions 82 of the key 80 engaged to the outer surface 70 of the cover plate 68. The flange 94 of the lock 88 engages an inner surface of the annular channel 76. The threaded member 96 engages the lock 88 and pulls the lock 88 such that the flange 94 is in contact with an interior surface of the annular channel 76 and the lip 82 is in contact with the outer surface 70. Fastening member 96 is torqued such that the lock assembly 72 is held within the opening 65 during operation.

Figure 7:
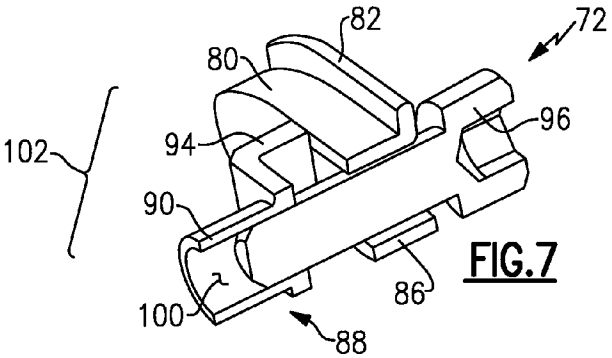
FIG. 7 is a cross sectional view of the example locking assembly set in an assembly position.

Referring to FIG. 7, the lock assembly 72 is shown in an assembly position 102. In the assembly position 102, the lock 88 is rotated about the axis 98 of the fastener 96 such that the flange 94 does not extend downwardly or outside of the key 80 periphery. This position allows the flange 94 and lock assembly 72 to be received within the opening 65.

Figure 8:
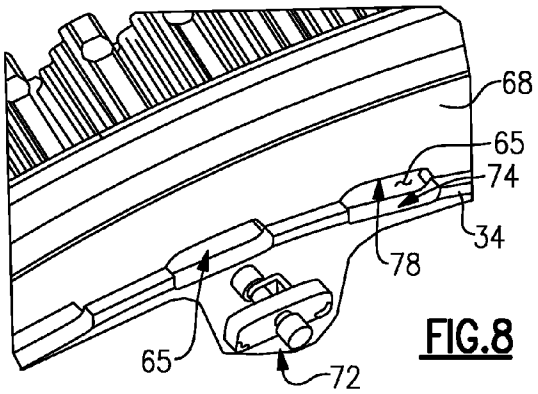
FIG. 8 is a perspective view of the example locking assembly being inserted into an example rotor slot.

Referring to FIG. 8, the example lock assembly 72 is received within the opening 65 due to the lock 88 being set in the assembly position 102 (FIG. 7). As appreciated the lock 88 could be turned to either side so long as it is disposed within a periphery of the key 80.

Figure 9:
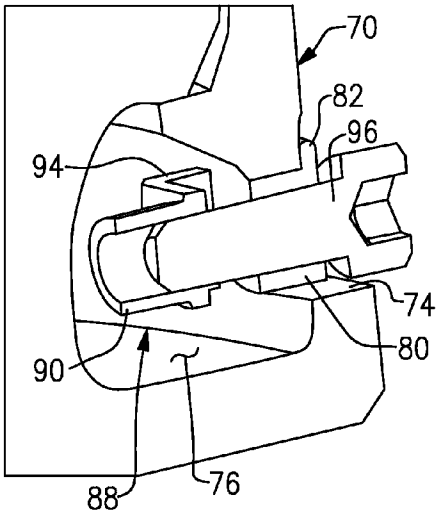
FIG. 9 is a cross sectional view of the example locking assembly inserted within the example rotor slot.

Referring to FIG. 9, a sectional view of the lock assembly 72 disposed within the opening 65 illustrates an initial position once received within the opening 65. In the initial position, the flange 94 is still in the assembly position 102 where the flange 94 is disposed within a space defined by the periphery of the key 80.

Figure 10:
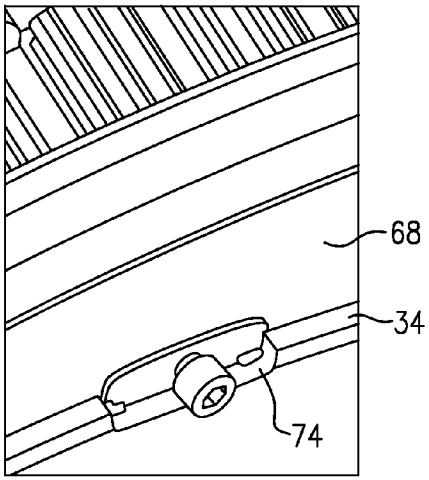
FIG. 10 is a perspective view of the example locking assembly received within a rotor slot.

Referring to FIG. 10, the lock assembly 72 is disposed within the opening 65 such that the key 80 is recessed from the aft surface 62 of the rotor 34. The recessed position of the lock assembly 72 reduces interruptions in the rotor surface that extend axially rearward of the rotor 34.

Figure 11:
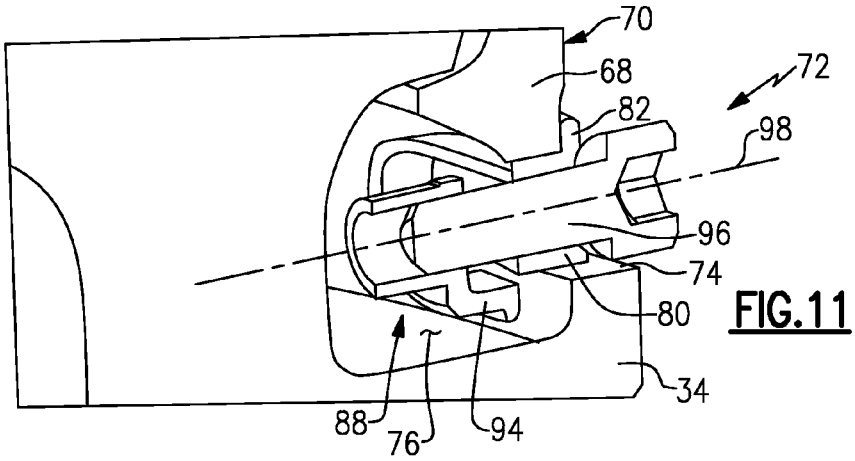
FIG. 11 is a cross sectional view of the example locking assembly with the lock rotated away from the assembly position.

Referring to FIG. 11, once the lock assembly 72 has been received within the opening 65, the threaded member 96 is pushed along the axis 98 to allow the flange 94 to rotate from behind the key 80. Rotation of the flange 94 of the lock 88 provides for the alignment of the flange 94 to engage an inner surface of the rotor annular channel 76. The lip 82 of the key 80 engages the outer surface of the cover plate 68. The fastener 96 is pushed into the annular channel 76 such that the lock portion 88 is pushed further into the rotor annular channel 76. Accordingly, the lock 88 can be rotated about the axis 98 and placed in a position where it may contact the inner surface of the rotor annular channel 76.

Figure 12:
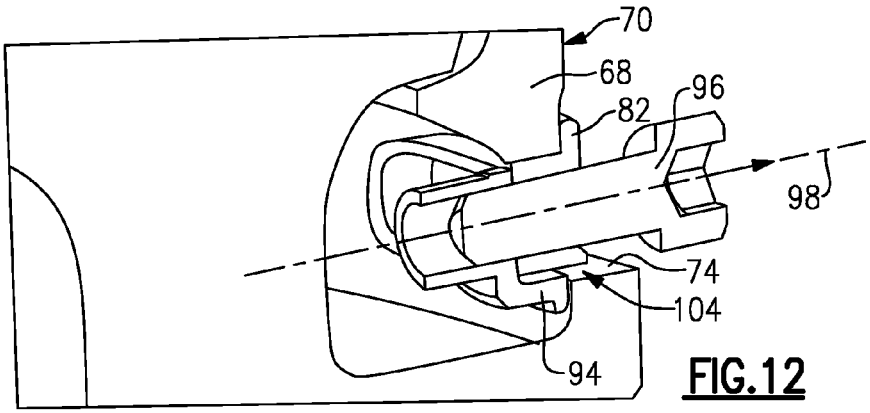
FIG. 12 is a cross sectional view of the example locking assembly with a lock disposed against an interior surface of the rotor.

Referring to FIG. 12, further assembly is conducted by pulling the fastening member 96 along the axis 98 outwardly in a direction where the lock 88 and specifically the flange 94 is moved into contact with an inner surface of the rotor annular channel 76. Once the flange 94 is engaged to the inner surface of the rotor annular channel 76 it engages a portion of the key 80 at an interface indicated at 104. The interface 104 prevents rotation of the lock 88 and the flange 94 relative to the key 80 and away from the desired locking position.

The opening 86 in the key 80 provides a slip fit for the fastening member 96 such that it may be pulled along the axis 98 to move the lock 88 and the flange 94 between assembly and locking positions.

Figure 13:
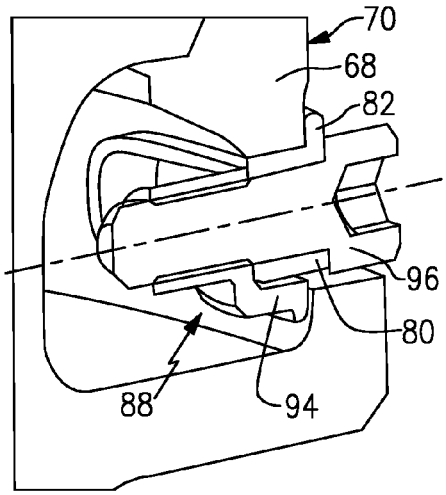
FIG. 13 is a cross sectional view of the example locking assembly in a locked position.

Referring to FIG. 13, the fastening member 96 is then tightened to draw the flange 94 against the inner surface of the rotor annular channel 76. At the same time that the fastening member 96 is pulling the flange 94 against the inner surface of the annular channel 76 it is also moving the lip 82 into contact with the cover plate 68.

The lock assembly 72 provides a first contact point defined by the flange 94 at a position below the axis 98. The locking assembly 72 includes a second contact point where the lip 82 contacts the outer surface 70 of the cover plate 68. Accordingly, the two contact points are spaced a distance apart from each other along the axis 98 and transverse to the axis 98.

In this example, the flange 94 abuts an inner surface of the annular channel 76 while a lip 82 of the key 80 abuts an outer surface 70 of the cover plate 68. The example lock assembly 72 is torqued to a desired torque to complete installation. The threads that are defined within the barrel section 90 of the lock 88 include an interference fit such that the threaded member 96 will not loosen due to vibratory or other operational conditions.

Figure 14:
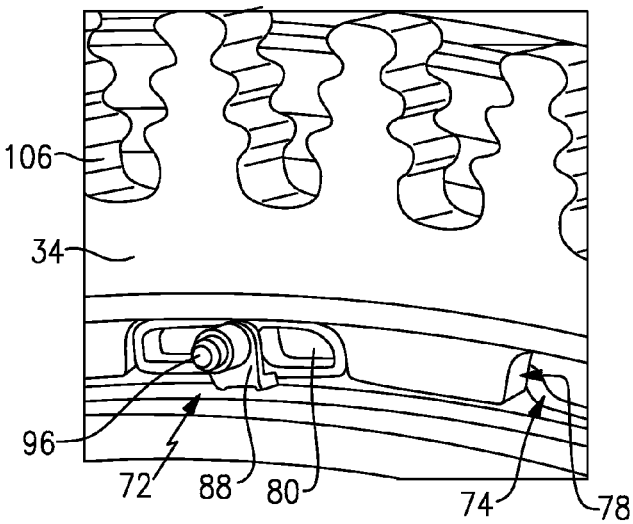
FIG. 14 is a rear perspective view of the example locking assembly received within a rotor slot.

Referring to FIG. 14, a rear view from within the annular channel 76 illustrates the contact provided by the flange 94. The example lock 88 is disposed in a specific orientation to provide the desired locking and securement of the lock assembly 72 within the opening 65.

Figure 15:
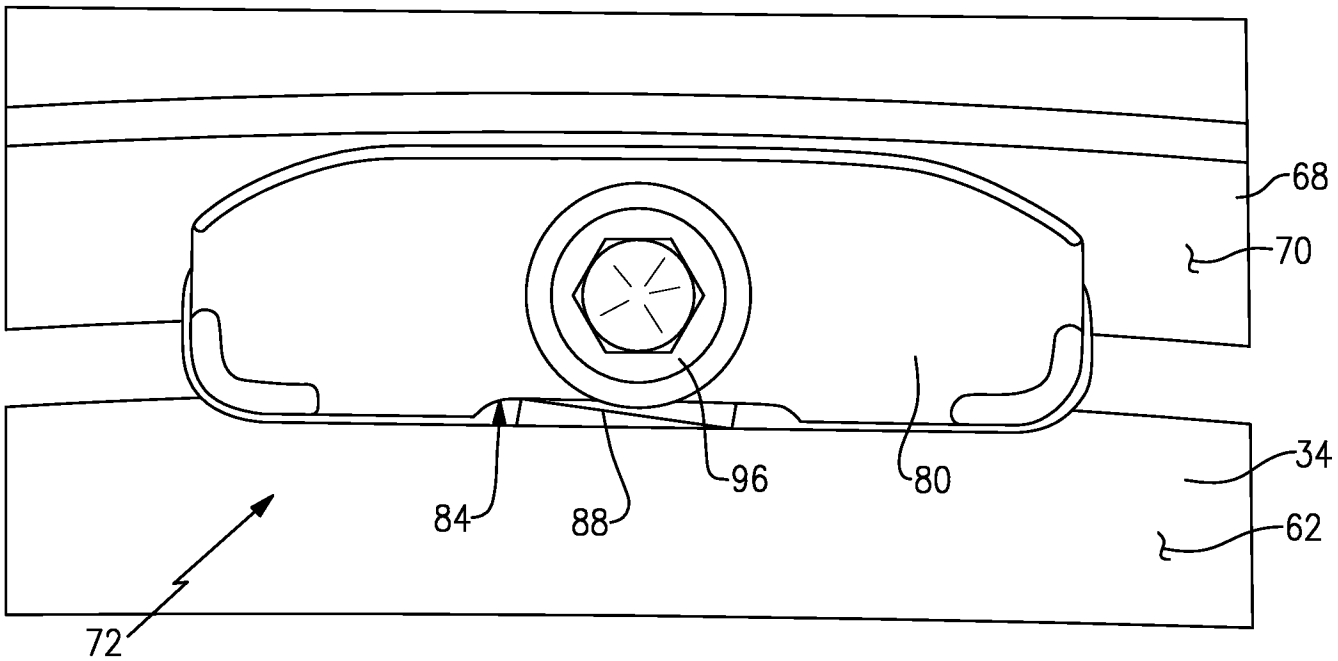
FIG. 15 is a front view of the example locking assembly in a locked condition.

Referring to FIG. 15, to further assure proper installation of the example lock assembly 72, the key 80 includes a window 84 through which the lock 88 can be viewed when fully assembled within the opening 65. In this example, the lock 88 is shown through the window 84 at a slight angle. The example window 84 provides for visual verification that the lock 88 is positioned within acceptable tolerances and provides a verification that the lock 88 is engaged as required to an inner surface of the rotor annular channel 76.

The disclosed example lock assembly 72 provides a securing function to prevent the rotation of the cover plate 68 towards a disassembly direction while also providing features that verify proper installation.

Although an example embodiment has been disclosed, a worker of ordinary skill in this art would recognize that certain modifications would come within the scope of this disclosure. For that reason, the following claims should be studied to determine the scope and content of this disclosure.

The invention claimed is:

1. A rotor assembly for a gas turbine engine comprising:

a rotor configured for rotation about an engine axis, the rotor including an aft surface including a rotor slot;

a cover plate attached to the aft surface of the rotor, the cover plate including a tab received within the rotor slot and a cover plate slot aligned with the rotor slot; and a lock assembly disposed within the rotor slot for holding a position of the cover plate relative to the rotor, the lock assembly including a key portion conforming to the rotor slot, a lock portion engageable with a surface of the rotor slot and a threaded member.

2. The rotor assembly as recited in claim 1, wherein the rotor includes an aft wall defining the rotor slot and an annular channel forward of the aft wall, wherein the tab is received through the rotor slot and rotated circumferentially within the annular channel to align the rotor slot and the cover slot.

3. The rotor assembly as recited in claim 2, wherein the lock portion includes a barrel disposed about a central axis and a flange extending from the barrel, the barrel including threads configured to receive the threaded member.

4. The rotor assembly as recited in claim 3, wherein the flange extends parallel to the central axis.

5. The rotor assembly as recited in claim 4, wherein the flange engages an inner surface of the annular channel of the rotor to hold the locking assembly within the rotor slot.

6. The rotor assembly as recited in claim 2, wherein the key includes a lip contacting the aft surface of the cover plate.

7. The rotor assembly as recited in claim 6, wherein the flange of the lock is engageable to a portion of the key to prevent relative rotation therebetween.

8. The rotor assembly as recited in claim 6, wherein the key includes a window for viewing a position of the lock when assembled to the rotor slot.

9. The rotor assembly as recited in claim 1, wherein the lock portion is movable relative to the key portion.

10. The rotor assembly as recited in claim 9, wherein the lock portion is movable between a first position enabling insertion of the key and lock into rotor slot and a second position enabling securement of the lock portion against a portion of the rotor.

11. A lock assembly for preventing movement between assembled structures of a turbine engine, the lock assembly comprising: a key including a lip configured to engage an outside surface of a cover plate of the assembled structures; a lock including a flange configured to engage an inner surface of a rotor disk of the assembled structures, wherein the lock is movable relative to the key between a first position enabling insertion of the key into an opening within the cover plate of the assembled structures and a second position enabling engagement of the lock to the rotor disk of the assembled structures; and a fastening member configured to hold the lock and key in a fastened position.

12. The lock assembly as recited in claim 11, wherein the lock comprises a barrel with an internal bore including threads corresponding to threads on the fastening member and a flange extending transverse to the bore.

13. The lock assembly as recited in claim 12, wherein the lock engages a portion of the key for controlling a position of the lock relative to the key.

14. The lock assembly as recited in claim 11, including a window.

15. The lock assembly as recited in claim 11, wherein the lip of the key defines a first contact surface and the flange defines a second contact surface spaced a distance from each other in a direction transverse to an axis of rotation of the fastening member.

16. A method of assembling a cover plate to a turbine rotor comprising:

inserting a tab of a cover plate through a rotor slot;

rotating the cover plate to align a cover plate slot with the rotor slot;

setting a locking assembly into an assembly orientation;

inserting the locking assembly into the rotor slot to contact a key with an outer surface of one of cover plate;

moving a lock of the locking assembly to a lock position; and tightening a fastener to engage the lock of the locking assembly within the rotor slot including tightening the fastener to engage the lock with an inner surface of the rotor and a lip of the key with the cover plate.

17. The method as recited in claim 16, including holding the assembly orientation of the lock relative to the key by contacting a portion of the lock with the key.

18. The method as recited in claim 16, including viewing a position of the lock through a window of the key for visually confirming a desired locking orientation of the lock.

* * * * *